US008910981B2

(12) United States Patent
Andiano et al.

(10) Patent No.: US 8,910,981 B2
(45) Date of Patent: Dec. 16, 2014

(54) DOOR LATCH

(75) Inventors: Jean Andiano, Oroer (FR); Malcom Shute, St. Germain la Poterie (FR)

(73) Assignee: AGCO SA, Beauvais (FR)

( * ) Notice: Subject to any disclaimer, the term of this patent is extended or adjusted under 35 U.S.C. 154(b) by 845 days.

(21) Appl. No.: 12/745,622

(22) PCT Filed: Oct. 23, 2008

(86) PCT No.: PCT/EP2008/008983

§ 371 (c)(1),
(2), (4) Date: Nov. 1, 2010

(87) PCT Pub. No.: WO2009/071155

PCT Pub. Date: Jun. 11, 2009

(65) Prior Publication Data

US 2012/0292922 A1 Nov. 22, 2012

(30) Foreign Application Priority Data

Dec. 8, 2007 (GB) ..... 0723994.0

(51) Int. Cl.
*E05C 9/12* (2006.01)

(52) U.S. Cl.
USPC ..... 292/56

(58) Field of Classification Search
CPC ..... E05B 85/045; E05B 15/024; E05B 2015/027; E05B 85/22; E05B 77/38
USPC ..... 292/340, 341.12 X, 341.13 X, 341.15, 292/341.18, 56, 341.19, DIG. 55, DIG. 60, 292/DIG. 61
See application file for complete search history.

(56) References Cited

U.S. PATENT DOCUMENTS

| | | | | |
|---|---|---|---|---|
| 3,281,176 | A * | 10/1966 | McKey | 292/216 |
| 3,350,128 | A * | 10/1967 | Martens | 292/341.12 |
| 4,784,416 | A * | 11/1988 | Crown et al. | 292/341.15 |
| 6,427,500 | B1 * | 8/2002 | Weinerman et al. | 70/135 |
| 6,811,209 | B2 * | 11/2004 | Woollett et al. | 296/190.11 |
| 8,047,584 | B2 * | 11/2011 | Rock | 292/340 |
| 2012/0067895 | A1 * | 3/2012 | Williams | 220/324 |

FOREIGN PATENT DOCUMENTS

GB 765268 * 1/1957

* cited by examiner

*Primary Examiner* — Mark Williams

(57) ABSTRACT

A door latch mechanism (10) comprises a pin (11) having an elongate axis, and releasable jaw means (12) comprising a pair of jaw elements (18) which engage the pin therebetween to latch a door (16) in a closed position to a door frame (14). The pin is mounted on the door or the door frame with biasing means, such as a pair of springs, so as to allow the pin to move substantially linearly in a direction perpendicular to the elongate axis of the pin and substantially parallel to the plane of the door when in the closed position. The movement of the pin (11) allowed by the biasing means caters for any vertical displacement of the door caused by worn hinges for example without any forced distortion of the door. The invention is of particular benefit to doors having no frame and which are susceptible to flexing and come with the associated risk of structural failure.

10 Claims, 4 Drawing Sheets

DOOR LATCH

BACKGROUND OF THE INVENTION

1. Field of the Invention

The invention relates to a door latch mechanism for latching a door in a closed position to a door frame. In particular, but not exclusively, the invention relates to a door latch for a vehicle.

2. Description of Related Art

A conventional door latch on a vehicle having a door and door frame comprises a pin which is engaged within a releasable jaw arrangement when the door is closed. The pin is mounted to either the door or the door frame. Patent application GB-765,268 describes such a mechanism.

With the continued drive to minimise weight on vehicles, doors are becoming increasingly prone to distortion, particularly when the door is large compared to the points of hinged attachment and/or when the door is frameless. Such distortion can result in a poor sealing of the door within the frame thus allowing drafts to affect the driver (or passengers) of a vehicle when operating in cold weather for example.

BRIEF SUMMARY OF THE INVENTION

It is an object of the present invention to provide an improved door latch mechanism which caters for doors which are susceptible to distortion in shape or position relative to the door frame.

In accordance with the invention there is provided a door latch mechanism comprising a pin having an elongate axis, and releasable jaw means comprising a pair of jaw elements which engage the pin therebetween to latch a door in a closed position to a door frame, wherein the pin is mounted on the door or door frame with biasing means so as to allow the pin to move substantially linearly in a direction which is both perpendicular to the elongate axis of the pin and substantially parallel to the plane of the door when in the closed position. By allowing the pin to move relative to the releasable jaw means and to the body upon which it is mounted then any misalignment in the two latch components are catered for without forcing the door to distort in shape or position. Advantageously, this maintains the desired seal around the periphery of the door.

The pin is preferably mounted in an elongate guide slot which determines the limit of said movement of the pin.

The biasing means may comprise a pair of springs which bias the pin towards a central position in the direction of movement. Advantageously, this allows the pin to move away from the central position either one way or the other in the linear line of movement.

In one embodiment the door consists of a sheet of transparent material hinged on a vehicle. In a second embodiment the door consists of a frameless sheet of glass hinged on a vehicle. The invention is particularly beneficial to such arrangements as frameless doors are susceptible to distortion in shape or position relative to the frame.

The invention is applicable especially to vehicles having frameless doors such as tractors which require cabs having high all-round visibility for the driver.

BRIEF DESCRIPTION OF THE DRAWINGS

An embodiment of the invention will now be described with reference to the accompanying figures wherein.

DETAILED DESCRIPTION OF THE INVENTION

Figure 1:
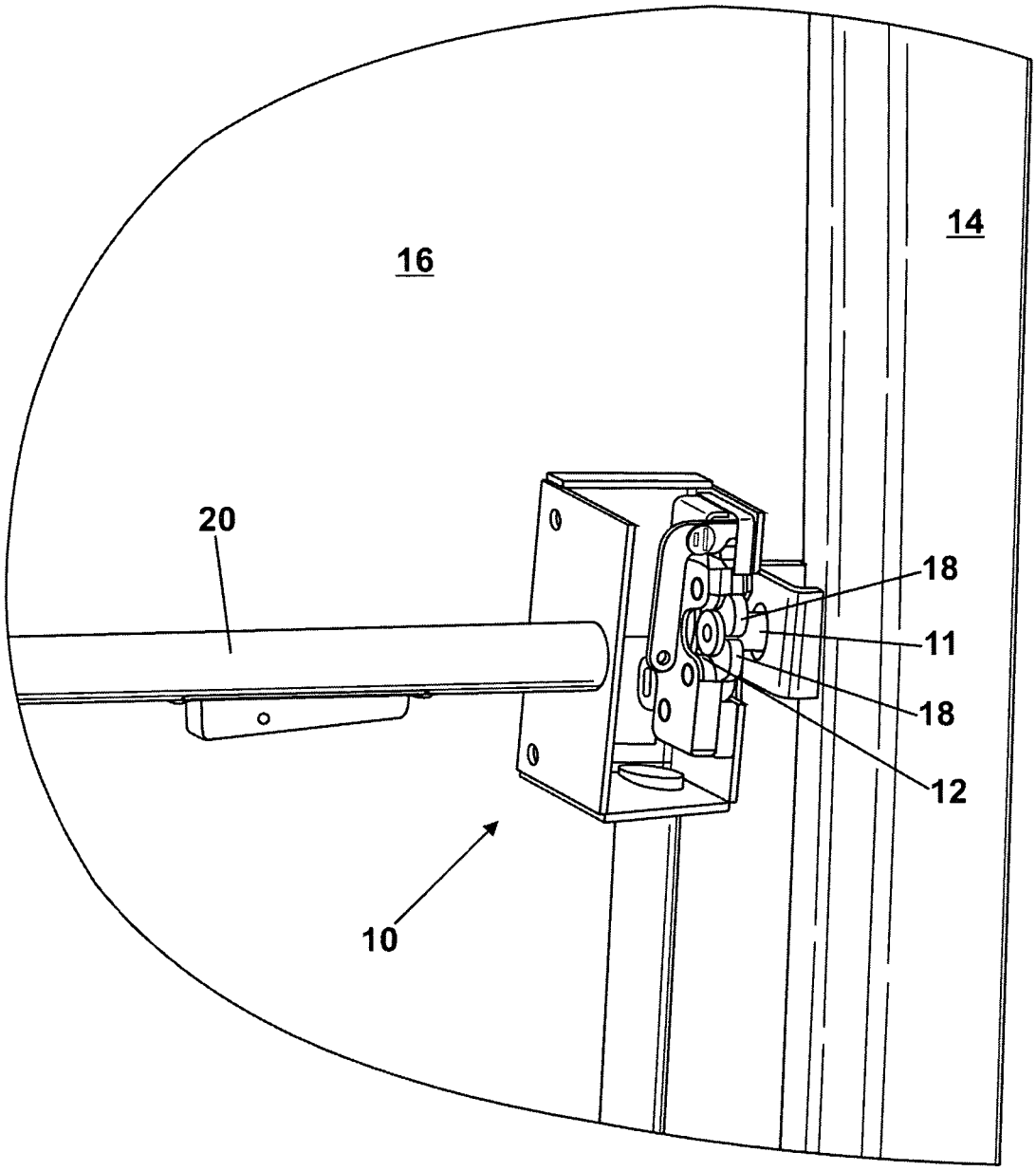
FIG. 1 is a perspective view of a door latch in accordance with the invention.

With reference to FIG. 1, a door latch 10 comprises a pin 11 and a releasable jaw mechanism 12. The pin 11 is formed of a rigid material and is mounted to a door frame having a support post 14.

The jaw mechanism 12 is mounted on a door 16. The door 16 consists of a frameless sheet of glass hinged on a tractor cab (not shown). The jaw mechanism 12 is mounted on the door 16 by bolts through holes in the sheet of glass.

The jaw comprises a pair of jaw elements 18 which are pivotally mounted to the body of the mechanism 12 and co-act to clamp to the pin 11 when engaged therein and lock the pin 11 in position. A release mechanism (not shown) serves to release the pin in response to an action by a user. The jaw elements 18 have rounded external edges at the opening to facilitate any minor misalignment as the pin is brought into engagement by guiding the pin into the jaw.

A handle 20 is attached to the door 16 to allow a user to push or pull the door open or closed from inside the tractor cab.

Figure 2:
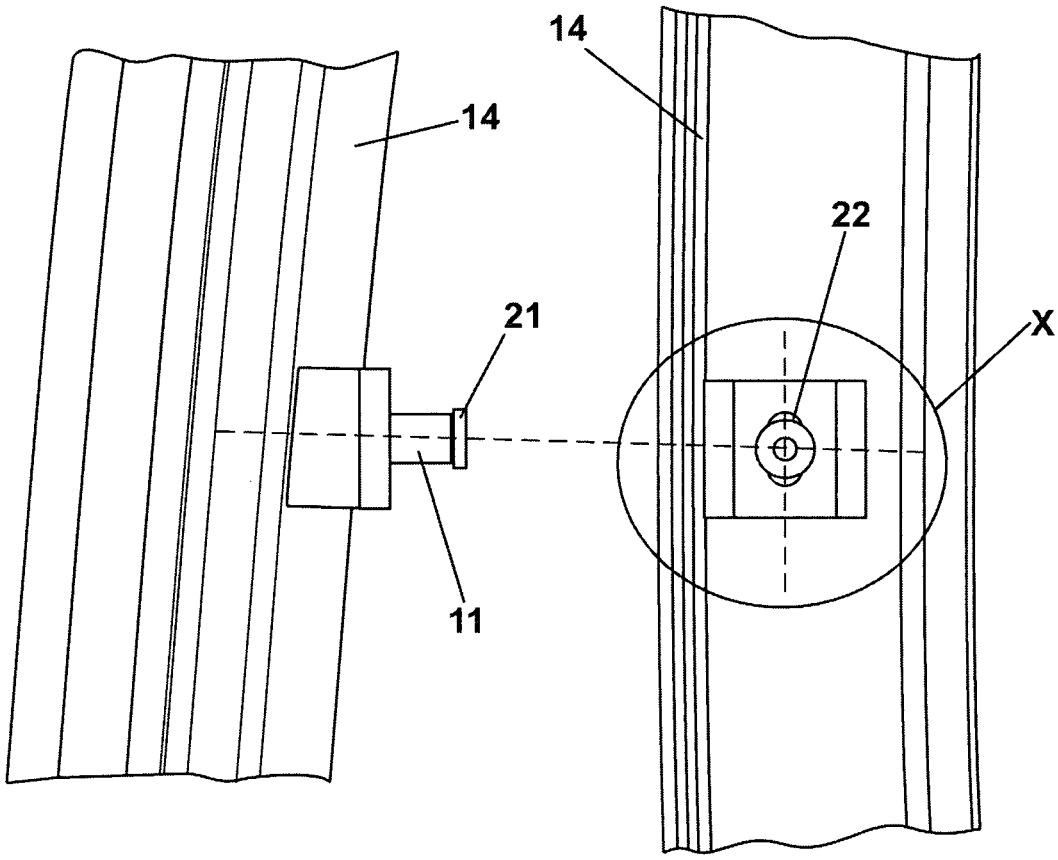
FIG. 2*a* is a side view of part of the door latch of FIG. 1 showing the pin in the central position.
FIG. 2*b* is an end-on view of the part of the door latch shown in FIG. 2*a;*

The pin 11 comprises a wider end portion 21 to prevent movement of the pin along the elongate axis when locked within the jaw elements 18. With reference to FIG. 2, the pin 11 is slidably mounted in an elongate slot 22 which allows the pin 11 to slide up or down within a range determined by the length of the slot 22.

Figure 3:
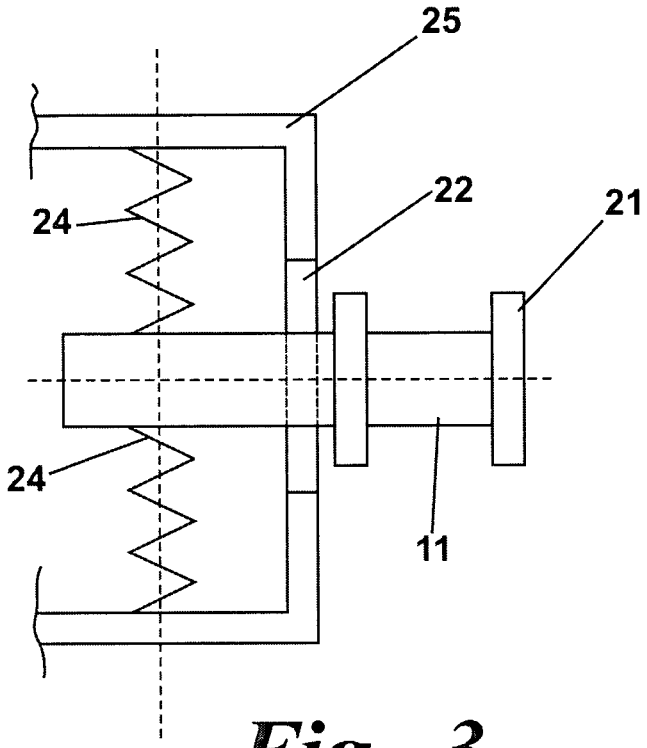
FIG. 3 is an enlarged sectional view of part of the door latch shown in FIG. 1.

FIG. 3 shows an enlarged sectional view of region X depicted in FIG. 2*b*. The pin 11 is fixed to one end of a pair of coil springs 24 concealed within a housing 25. The other respective ends of the springs 24 are fixed relative to the housing 25. FIGS. 1, 2 and 3 depict the pin 11 in a central position within the slot 22.

Figure 4:
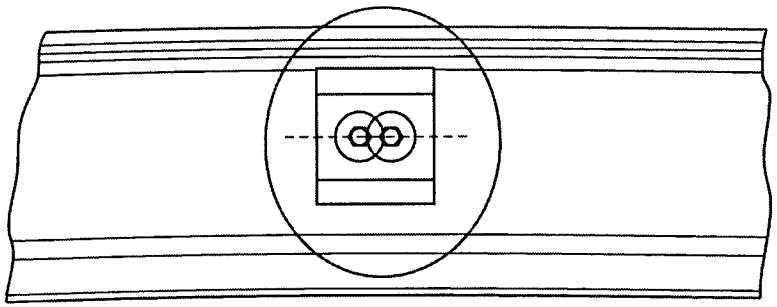
FIG. 4 is an end-on view of the part of the door latch shown in FIG. 2 but showing the pin at the limits of movement.
Figure 5A:
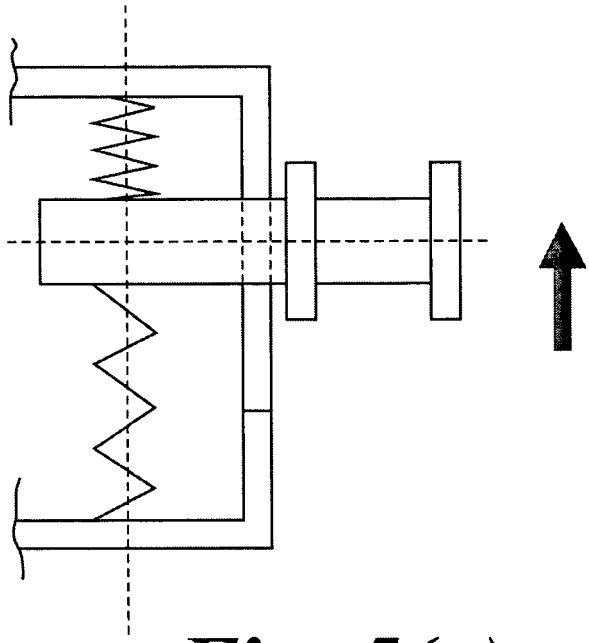
FIG. 5*a* is a sectional view of the part of the door latch shown in FIG. 3 showing the pin at the upper limit of movement; and, FIG. 5*b* is a sectional view of the part of the door latch shown in FIG. 3 showing the pin at the lower limit of movement.
Figure 5B:
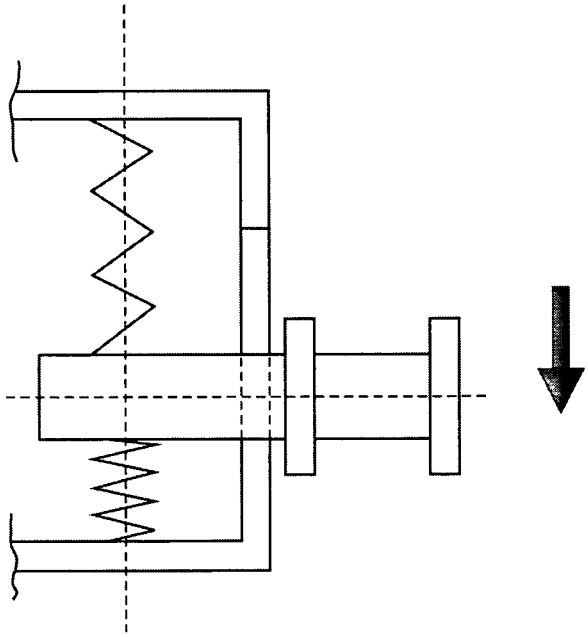

With reference to FIGS. 4 and 5, the pin 11 is free to displace from the central position within the slot 22. The pin can displace upwardly (FIG. 5*a*) or downwardly (FIG. 5*b*). The springs 24 bias the pin 11 to the central position.

The movement of the pin 11 allowed by the springs 24 and the slot 22 caters for any vertical displacement of the door, caused by worn hinges for example, without any forced distortion of the door. Although the invention is clearly applicable to any door, it is of particular benefit to doors having no frame and which are susceptible to flexing and come with the associated risk of structural failure. The described embodiment applies the invention to a tractor. However, it should be appreciated that the invention is also, and not exclusively, applicable to other vehicles.

Although the above described embodiment includes the pin mounted to the door frame, it is envisaged that the pin may be instead mounted to the door with the jaw mechanism fixed to the door frame whilst remaining within the scope of the invention. Furthermore, the pin 11 and jaw mechanism 12 can be mounted relative to each other on any edge of a door, for example the top edge, without deviating from the scope of the invention.

Various modifications to those embodiments described above, which remain within the scope of the invention, will be apparent to the skilled person.

The invention claimed is:

1. A door latch mechanism comprising a pin having an elongate axis, and a releasable jaw mechanism comprising a pair of jaw elements which engage the pin therebetween to latch a door in a closed position to a door frame, wherein the jaw mechanism is mounted on the door or door frame and the pin is mounted on the other of the door or door frame with biasing means, the biasing means comprising a pair of springs, with a first spring of said pair of springs biasing the pin in a first direction and a second spring of said pair of springs biasing the pin in a second direction, with the second direction opposing the first direction, so as to allow the pin to move substantially linearly against the bias of either the first or the second spring in a direction which is both perpendicular to the elongate axis of the pin and substantially parallel to the plane of the door when in the closed position.

2. A door latch mechanism according to claim 1, wherein the pin is mounted in an elongate guide slot parallel to the direction of bias for the pair of springs which determines the limit of said movement of the pin.

3. A door latch mechanism according to claim 2, wherein the pair of springs bias the pin towards a central position in the direction of movement.

4. A door latch mechanism according to claim 2, wherein the door consists of a sheet of transparent material hinged on a vehicle.

5. A door latch mechanism according to claim 2, wherein the door consists of a frameless sheet of glass hinged on a vehicle.

6. A door latch mechanism according to claim 1, wherein said pair of springs bias the pin towards a central position in the direction of movement.

7. A door latch mechanism according to claim 6, wherein the door consists of a sheet of transparent material hinged on a vehicle.

8. A door latch mechanism according to claim 6, wherein the door consists of a frameless sheet of glass hinged on a vehicle.

9. A door latch mechanism according to claim 1, wherein the door consists of a sheet of transparent material hinged on a vehicle.

10. A door latch mechanism according to claim 1, wherein the door consists of a frameless sheet of glass hinged on a vehicle.

* * * * *